US008651165B2

(12) United States Patent
Huynh et al.

(10) Patent No.: US 8,651,165 B2
(45) Date of Patent: Feb. 18, 2014

(54) BREAKAWAY DOOR PANEL SYSTEM

(76) Inventors: Gia Loc Huynh, Montreal (CA); Viet Pham, St-Laurent (CA); Marco Foster, Mont Saint-Gregoire (CA)

( * ) Notice: Subject to any disclaimer, the term of this patent is extended or adjusted under 35 U.S.C. 154(b) by 766 days.

(21) Appl. No.: 12/215,477

(22) Filed: Jun. 27, 2008

(65) Prior Publication Data

US 2009/0000199 A1 Jan. 1, 2009

Related U.S. Application Data

(60) Provisional application No. 60/958,009, filed on Jul. 3, 2007.

(30) Foreign Application Priority Data

Jun. 27, 2007 (CA) ..... 2592895

(51) Int. Cl.
*E05D 15/00* (2006.01)

(52) U.S. Cl.
USPC ..... 160/205; 49/197; 49/9

(58) Field of Classification Search
USPC ..... 49/141, 9, 34, 197, 198, 199, 152, 153, 49/155, 176; 160/205, 180, 200
See application file for complete search history.

(56) References Cited

U.S. PATENT DOCUMENTS 3,126,944 A * 3/1964 Kempinski ..... 160/90
4,294,055 A * 10/1981 Andresen ..... 52/784.1
4,397,115 A * 8/1983 Crawford ..... 49/70
5,584,333 A * 12/1996 Torchetti et al. ..... 160/201
5,720,332 A * 2/1998 Nachreiner ..... 160/205
5,727,614 A * 3/1998 Lichy ..... 160/201
5,782,283 A * 7/1998 Kendall ..... 160/229.1
6,053,237 A * 4/2000 Bertilsson et al. ..... 160/205
6,315,027 B1 * 11/2001 Lichy ..... 160/205
6,615,898 B2 9/2003 Schulte
7,296,608 B2 11/2007 Weishar et al.
7,832,451 B2 * 11/2010 Miller et al. ..... 160/113
2005/0076591 A1 * 4/2005 Koeller ..... 52/311.1

FOREIGN PATENT DOCUMENTS

WO WO 99/22103 5/1999

* cited by examiner

*Primary Examiner* — Katherine Mitchell
*Assistant Examiner* — Catherine A Kelly

(57) ABSTRACT

The present invention is generally concerned with a breakaway door panel system comprising an impact resistant panel pivotally assembled to a pair of connecting members mountable to a door adjacent a first end and a second end of the panel respectively, and at least one impact releasable panel locking device comprising a first compliant holding element mounted at an end of the panel, a second complementary compliant holding element mounted to one of the connecting member adjacent the panel end, and a connecting bar releasably connecting the first holding element to the second holding element, whereby, when an impact force of at least a predetermined strength in applied to the panel, the bars are extracted from at least one of their respective holding elements, leaving the panel break away from the door, pivoting in the direction of the impact force.

13 Claims, 11 Drawing Sheets

BREAKAWAY DOOR PANEL SYSTEM

CROSS-REFERENCE TO RELATED APPLICATIONS

This application claims priority to U.S. provisional patent application No. 60/958,009 filed on Jul. 3, 2007, which is incorporated by reference herein.

FIELD

The present invention generally relates to door locking systems. More specifically, the invention is concerned with an impact releasable panel system for preventing industrial doors from being damaged by bumping.

BACKGROUND

Many types of systems and mechanisms have been provided in the prior art in order prevent industrial doors, and more specifically multi-panel articulated overhead doors such as garage doors, to be damaged by inadvertent impacts from circulating vehicles.

However, those systems and mechanisms generally suffer from one or more of the following limitations and drawbacks. They can not be retrofitted to a standard existing door railing, and/or they do not enable impact compensation in both directions, and/or the releasable mechanism is complex and expensive and/or difficult to resume into normal operation after yielding.

It would therefore be a significant advance in the art of impact-resistant door systems to provide a breakaway door panel system which is releasable under inward or outward impact of a predetermined strength, is simple, low cost and easy to put back in service rapidly and without significant physical effort.

OBJECTS

An object of the present invention is therefore to provide a breakaway door panel system obviating the limitations and drawbacks of the prior art systems and mechanisms.

DETAILED DESCRIPTION

Figure 1A:
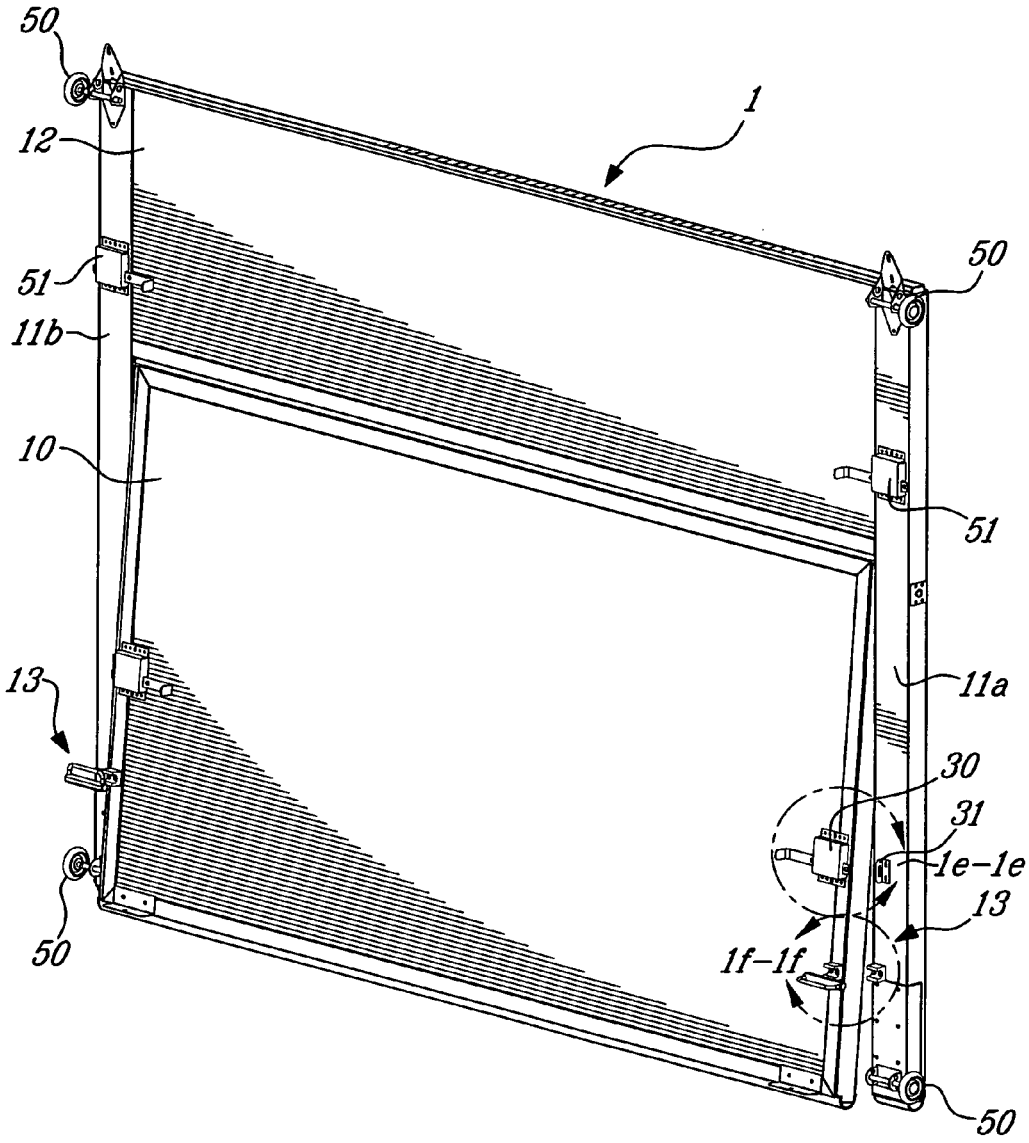
FIG. 1*a* is a perspective view of a portion of an overhead multi-panel door embodying the breakaway door panel system according to an illustrative embodiment of the present invention.

In accordance with an illustrative embodiment of the present invention, there is provided a breakaway door panel system to be mounted to tracks via rollers; the system comprising:

- first and second connecting members to which the rollers are mounted;
- an impact resistant panel pivotally assembled between the first and second connecting members;
- at least one impact releasable panel locking device comprising:
  - a first holding element mounted to the panel in the proximity of a connecting member;
  - a second holding element mounted to the connecting member in the proximity of the first holding element; and
  - a connecting bar so configured and sized as to be releasably connectable to the first and second holding elements;
- wherein, when an impact force of at least a predetermined magnitude is applied to the impact resistant panel, the connecting bar of the at least one impact releasable panel locking device is extracted from at least one of the first and second holding elements, allowing the panel to break away from the door, pivoting in the direction of the impact force.

According to another aspect of the present invention, there is provided an impact releasable panel locking device to be mounted to a door pivotally mounted to a wall by a pivoted edge; the door having at least one free edge in the proximity of a fixed structure, the locking device comprising:

- a first holding element mounted to the pivotable door in the proximity of a free edge thereof;
- a second holding element mounted to the fixed structure in the proximity of the first holding element; and
- a connecting bar so configured and sized as to be releasably connectable to the first and second holding elements
- wherein, when an impact force of at least a predetermined magnitude is applied to the door, the connecting bar is extracted from at least one of the first and second holding elements, allowing the door to pivot in the direction of the impact force.

According to another aspect of the present invention, there is provided a breakaway door panel system to be mounted to tracks via rollers; the system comprising:

first and second connecting members to which the rollers are mounted; the first and second connecting members respectively include first and second shafts so mounted thereto as to face each other;

an impact resistant panel including first and second bores so configured, sized and positioned as to respectively receive the first and second shafts to thereby pivotally mount the impact resistant panel to the first and second connecting members so as to have a pivotable range of about 90 degrees on either sides of a plane defined by the first and second connecting members; and at least one impact releasable panel locking device;

wherein, when an impact force of at least a predetermined magnitude is applied to the impact resistant panel, the at least one impact releasable panel locking device allows the panel to break away from the door, pivoting in the direction of the impact force.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

Other objects, advantages and features of the present invention will become more apparent upon reading of the following non-restrictive description of illustrative embodiments thereof, given by way of example only with reference to the accompanying drawings.

Although the present description will be described hereinbelow with reference to a multi-panel articulated vertically movable overhead door such as a garage door, illustrative embodiments of the present invention shall be deemed applicable to a plurality of doors susceptible to damages resulting from impacts.

Generally stated, illustrative embodiments of the present invention relate to an impact resistant breakaway panel system pivotally assembled into a door, the panel being normally held closed in the plane of the door, providing tight closure of the door opening. Upon impacting of the door in the region of the panel with a given strength, the panel automatically unlocks and pivots in the direction of the impact, absorbing the impact energy and thus preventing damages to the door and to the door mounting structure.

Another aspect of the present invention relates to an impact releasable panel locking device mounted to a pivotable door or panel and to an adjacent fixed structure to allow the door or panel to pivot only when an impact force is applied to the door or panel.

FIG. 1*a* shows an isometric view of an impact resistant breakaway panel system 1 according to an illustrative embodiment of the present invention. The panel system 1 comprises an impact resistant panel 10, pivotally assembled between a pair of connecting members 11*a* and 11*b* defining a fixed structure with respect to the pivotable panel 10. The panel system 1 also includes a fixed panel 12 mounted to the connecting members 11*a* and 11*b* to form a panel of a multi-panel sectional overhead door. A pivoting assembly, which will be described in detail hereinbelow, enables the panel 10 to swing inwardly and outwardly with respect to the door plane defined by the connecting members 11*a* and 11*b*. This assembly including the panel 10, connecting members 11*a* and 11*b* and the fixed panel 12 constitutes one of the interconnected panels of the door. The assembly carries a pair of upper rollers 50*a* and a pair of lower rollers 50*b* to ride as a conventional door panel in a conventional set of lateral tracks (not shown). Whenever desirable, vertical movement of the door may be prevented using a pair of slide bolt locks 51 associated with the connecting members 11*a*, 11*b* and cooperating with the conventional door tracks to lock the door in a manner well known by those with ordinary kill in the art.

The top edge of the panel 10 defines a pivoted edge since it is in the proximity of the top edge that the pivot assembly is mounted, as will be described hereinbelow. The side edges of the panel 10 define free edges of the panel.

To provide a panel 10 having the appropriate impact resistance, a special sandwich structure is being contemplated. A light center core such as expanded polystyrene (EPS) or honeycomb panel is laminated on both sides with a continuous fiber reinforced thermoplastic composite thin layer comprising a glass fiber web embedded in a matrix of thermoplastic polymer material such as polyethylene. A very high rigidity and impact resistance is thereby provided in spite of the low panel density and weight, which ensures proper behavior under impact stress. An esthetic film can further be laminated on the functional skins to impart desired texture and color to the panel 10. Of course, other panel structures providing the desired high rigidity and impact resistance can be used.

Figure 1B:
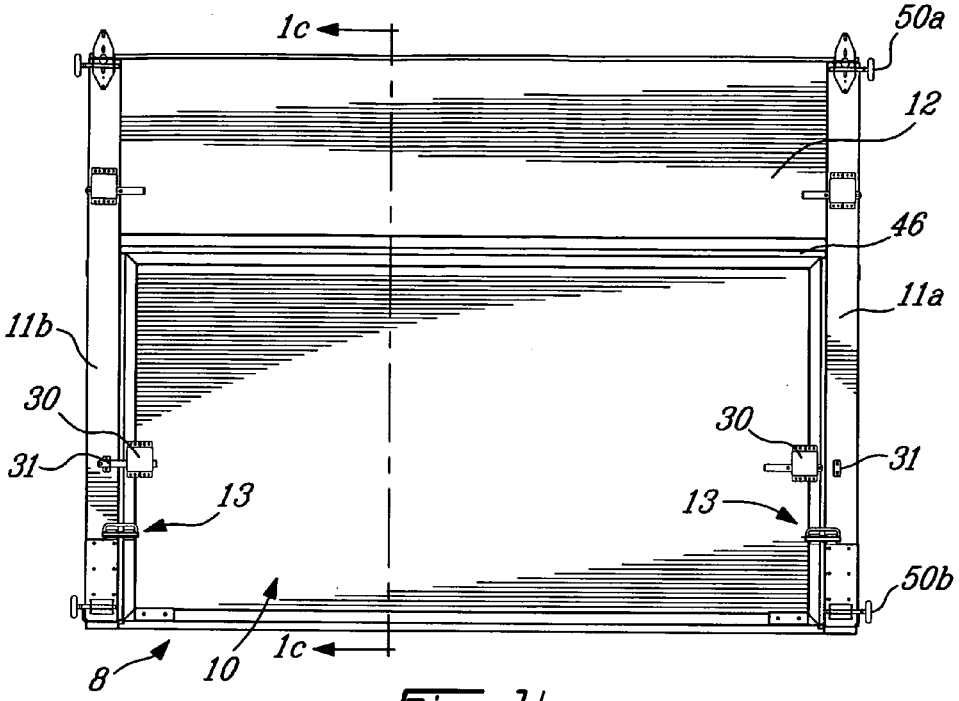
FIG. 1*b* is a front elevation view of the system of FIG. 1*a;*
Figure 1C:
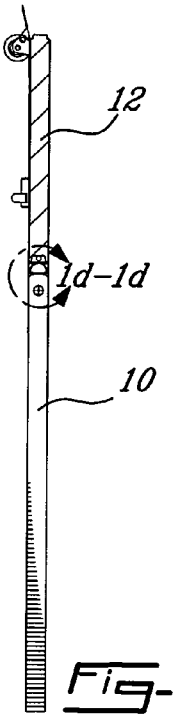
FIG. 1*c* is a side cross-sectional view taken from line A-A of FIG. 1*b;*
Figure 1D:
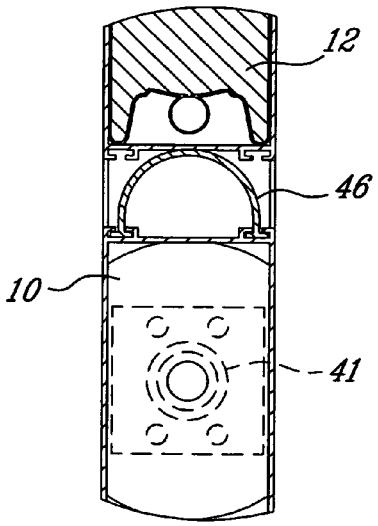
FIG. 1*d* is an enlarged side elevation view of detail B of FIG. 1*c;*

The breakaway panel system 1 further comprises a pair of impact releasable panel locking devices 13 (see FIGS. 1*f* and 4 *a-d*) respectively provided between a free edge of the panel 10 and an adjacent connecting member 11*a*, 11*b*. Each panel locking device 13 comprises a first resilient holding element 14 having a generally C-shaped cross-section and mounted to the panel 10 close to a free edge thereof and a second similar holding element 15 mounted to the fixed structure, i.e. the corresponding adjacent connecting member. The locking device 13 further comprises a connecting bar 20 provided with an elongated cylindrical bar body 21 and a handle 22. The resilient holding elements 14 and 15 each define a cavity 16 having a mouth width 17 and a bore diameter 18 and are mounted in axial alignment when the door panel 10 is in the closed position shown in FIG. 1*b*. The connecting bar 20 defines a cylindrical shape having a generally circular cross-section conforming to the bore diameter 10 and a single or two opposing flat surfaces 23 to define a narrower bar profile slightly smaller than the mouth width 17. The bar body 21 may be easily sled into a cavity 16 to interconnect the first and second holding elements 14 and 15 by aligning the flat surfaces 23 in the mouth 17. As best viewed from FIGS. 4*a* to 4*d*, rotating the bar 20 by an angle of about ninety degrees about the holding elements axis engages and locks the bar body 21 into the cavities 16, the handle weight providing a downward biasing force ensuring stable positioning of the bar.

Of course, a completely cylindrical connecting bar (not shown) could also be used. When this is the case, the connecting bar would be axially slid in the aligned first and second holding elements.

One skilled in the art will understand that more or less than two impact releasable panel locking devices 13 could be used.

The resilient holding elements 14 and 15 may be made from a polymer material such as polypropylene or from a soft metal such as aluminum to ensure resiliency of the mouth 17. The connecting bar 20 may be made of stiff and solid material such as steel, for example.

Figure 4A:
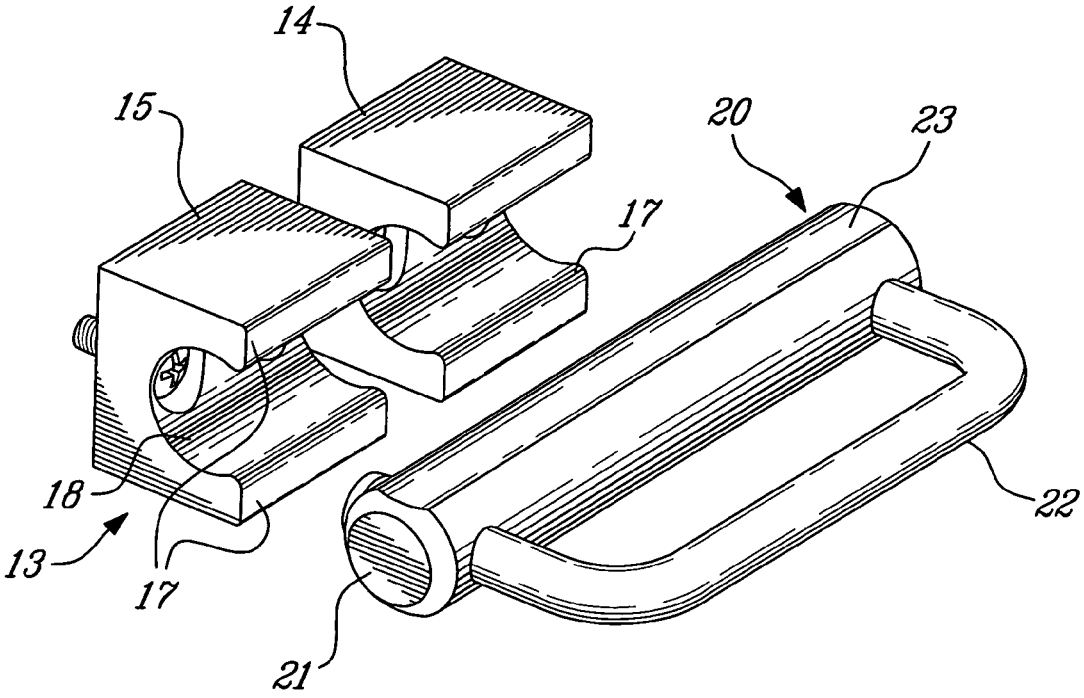
FIG. 4*a* is a perspective view of a releasable panel locking device shown with the connecting bar removed from the two resilient holding elements.
Figure 4B:
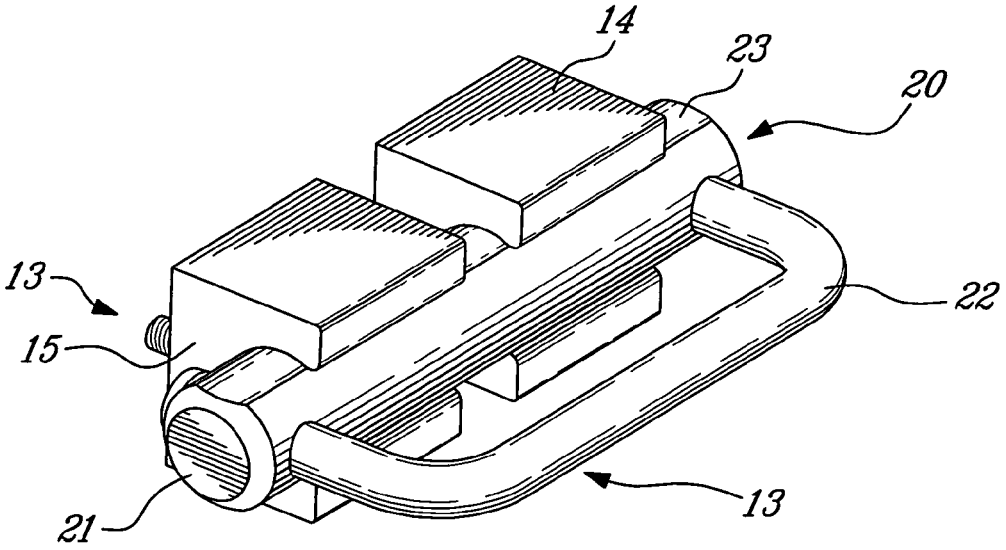
FIG. 4*b* is a perspective view of a releasable panel locking device shown with the connecting bar mounted to the two resilient holding elements.
Figure 4C:
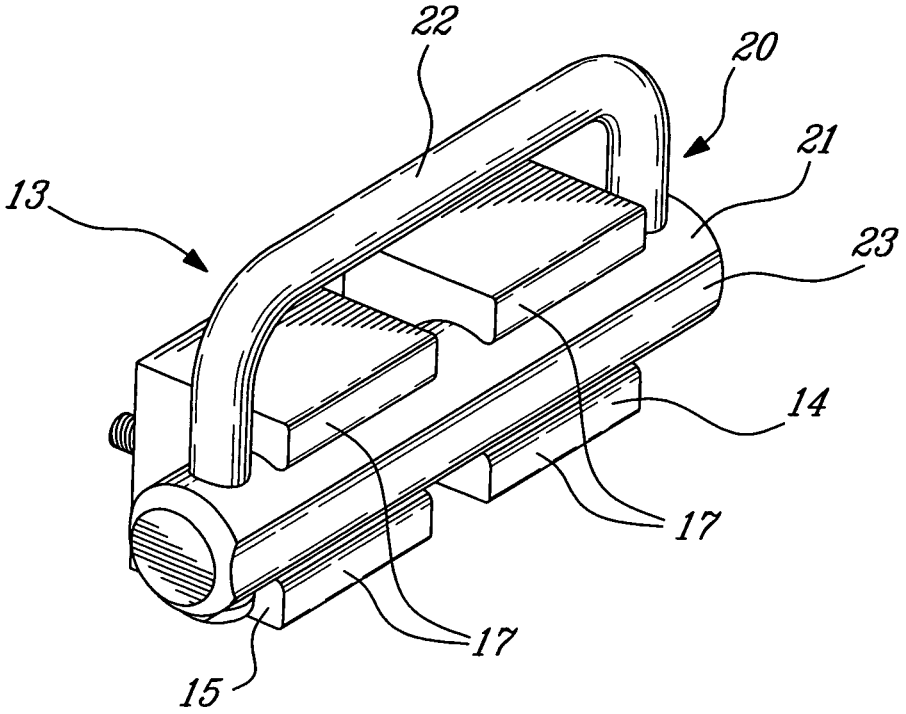
FIG. 4*c* is a perspective view of a releasable panel locking device shown with the connecting bar positioned upwardly into operating position.
Figure 4D:
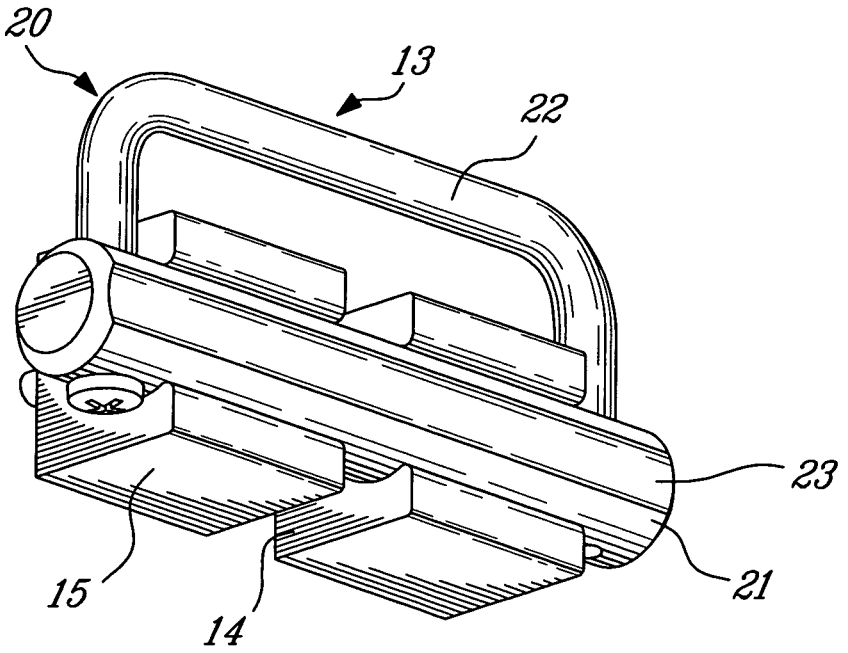
FIG. 4*d* is a bottom perspective view of the releasable panel locking device shown with the connecting bar positioned downwardly into operating position.

In operation, once the connecting bar body 21 is positioned into the holding elements cavities 16 as shown in FIGS. 4*c* and 4*d* in a locked position, applying an inwardly or outwardly oriented impact force of at least a predetermined magnitude on the panel 10 will force bar body 21 to move in the direction of the mouth of either of holding elements 14, 15 forcing the bar 20 out of the mouth. More specifically, should the force be applied outwardly, the bar body 21 would be forced out of the holding element 15. On the other hand, should the force be applied inwardly, the bar body 21 would be forced out of the holding element 14.

The magnitude of the impact force required to open the mouth and free the bar body 21 from a holding element may be determined by design, as a function of the element dimensions and material mechanical properties. Therefore, application of a force or impact of at least a predetermined magnitude on the panel 10 in an inward or outward direction will cause the bars 21 to escape from at least one of the cavities 16 and allow the panel 10 to pivot about its pivoted edge. The energy used to force the bar body 21 out of a cavity, decreases the energy from the impact and prevents the door and its supporting structure to support a force superior to the designed pull-out force of the panel locking devices 13.

After the ejection of a bar 20 from a cavity 16 following an impact on panel 10, the bar can be easily repositioned into the cavity as shown in FIGS. 4*a* to 4*d* to resume the operating state. It can thus be appreciated that no significant physical force is required from the user to operate this repositioning, despite the relatively high releasing force provided.

Figure 1E:
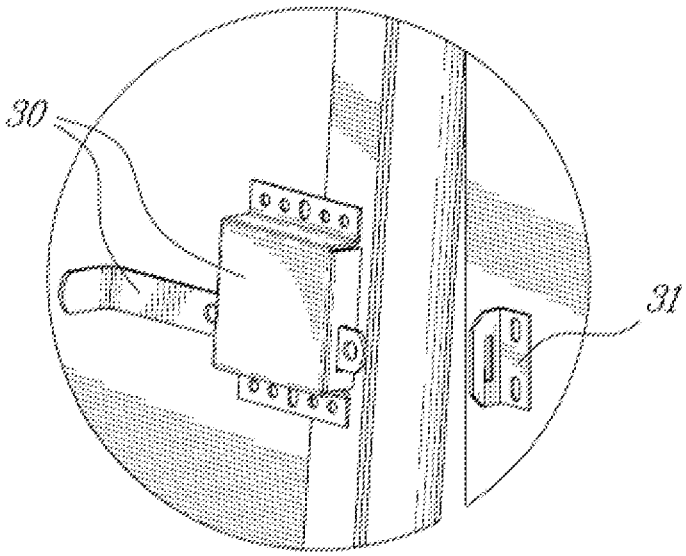
FIG. 1*e* is an enlarged perspective view of detail C of FIG. 1*a*, showing a slide bolt panel lock.
Figure 1F:
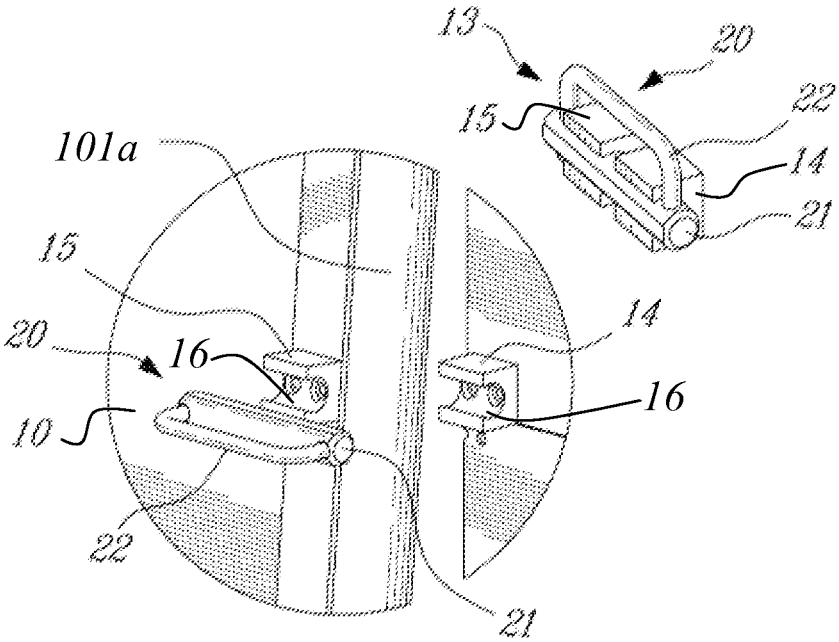
FIG. 1*f* is an enlarged perspective view of detail D of FIG. 1*a* showing a releasable panel locking device.
Figure 2A:
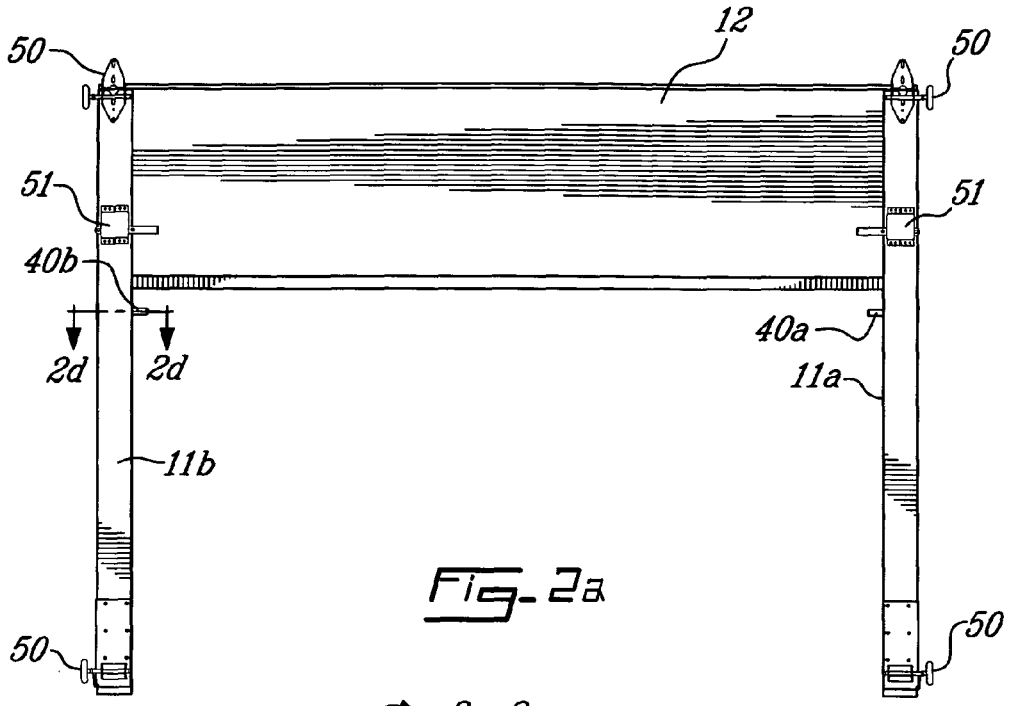
FIG. 2*a* is a front elevation view of the breakaway door panel system of FIG. 1*b* with the door panel removed to show the details of the pivoting mechanism.
Figure 2B:
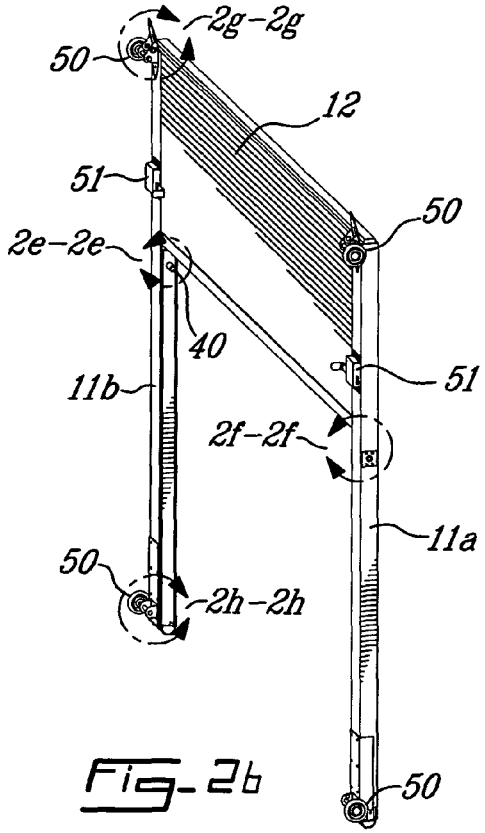
FIG. 2*b* is a perspective view of the breakaway door panel system of FIG. 2*a;*
Figure 2C:
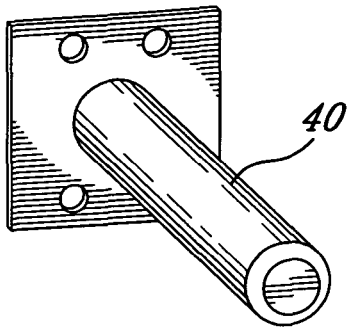
FIG. 2*c* is a perspective view of a pivot shaft.
Figure 2D:
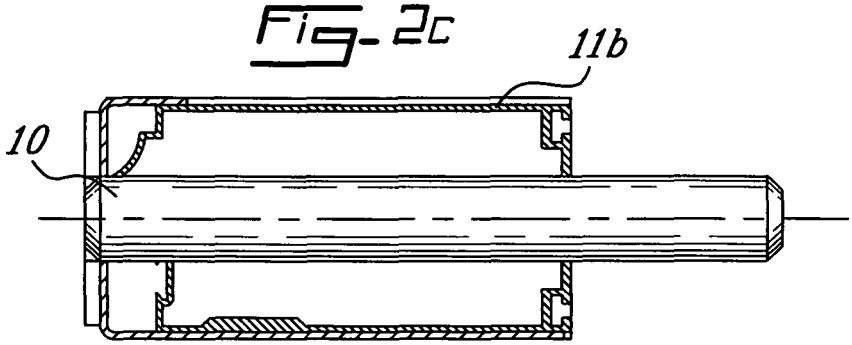
FIG. 2*d* is a top cross-sectional view taken from line E-E of FIG. 2*a;*
Figure 2E:
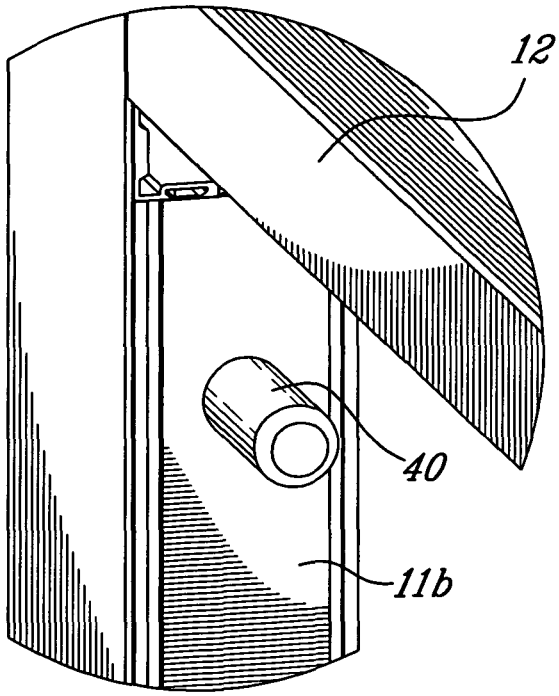
FIG. 2*e* is an enlarged view of detail F of FIG. 2*b;*
Figure 2F:
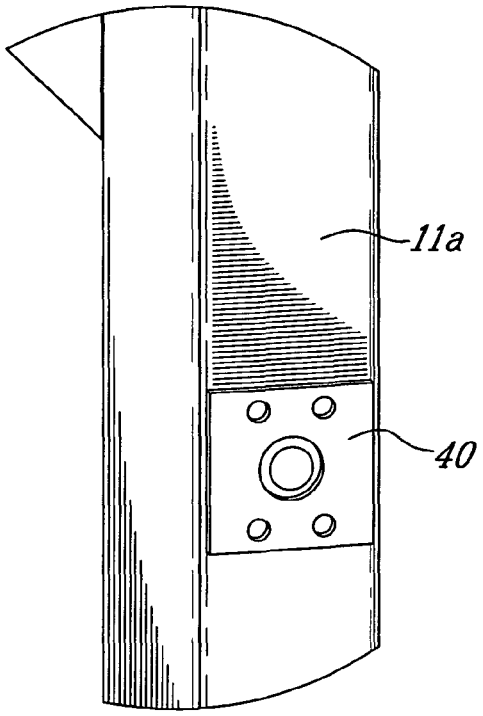
FIG. 2*f* is an enlarged view of detail G of FIG. 2*b;*
Figure 2G:
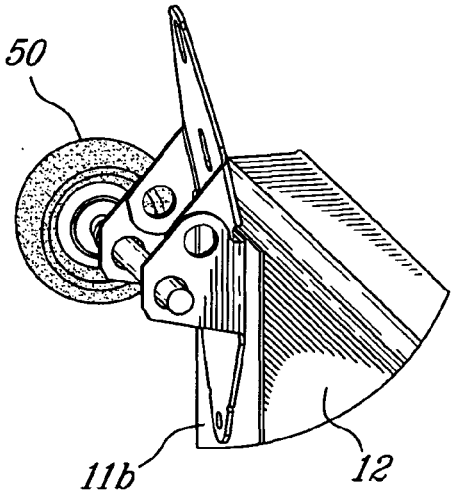
FIG. 2*g* is an enlarged view of detail J of FIG. 2*b;*
Figure 2H:
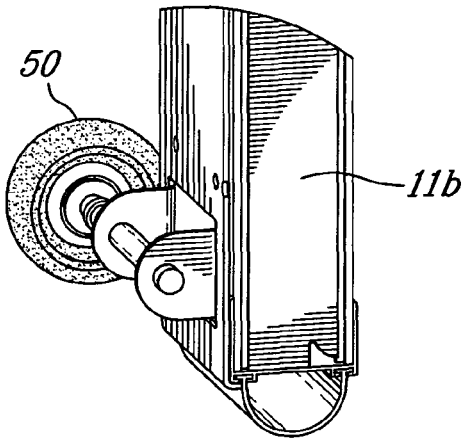
FIG. 2*h* is an enlarged view of detail K of FIG. 2*b;*

To provide a positive and safe lock of the panel into the door whenever desired, slide bolt locks 30 are further mounted to the panel 10, co-operating with slotted flanges 31 mounted on connecting members 11*a*, 11*b*, as illustrated in FIGS. 1*a* and 1*e*.

Turning now to FIGS. 2 and 3, the panel pivoting system will now be described in more detail. As best viewed from FIG. 2*e*, shafts 40*a* and 40*b* facing each other project from the members 11*a* and 11*b* respectively. Each shaft 40 is so configured and sized as to engage one of bore holes 41*a* and 41*b* provided at each end of panel 10 as shown in FIG. 3*d*. In order to enable smooth and durable operation of the panel pivoting system, a lubricated bushing or roller bearing 41' may be provided in the bore 41 to receive the shaft 40. One can thus appreciate that the panel 10, so mounted between members 11*a* and 11*b*, is free to pivot back and forth about the pivot axis defined by shafts 40 and bores 41. Members 11*a* and 11*b* are preferably made from extruded aluminum profiles and shafts 40 are assembled through the members as shown in the cross-sectional view of FIG. 3*d*.

As will easily be understood by one of ordinary skills in the art, the panel pivoting system allows the impact resistant panel to be pivotally mounted between the first and second connecting members so as to have a pivotable range of about 90 degrees on either sides of a plane defined by the first and second connecting members. Of course, the 90 degree range on either sides of the plane defined by the first and second connecting members can be significantly more than 90 degrees.

Figure 3A:
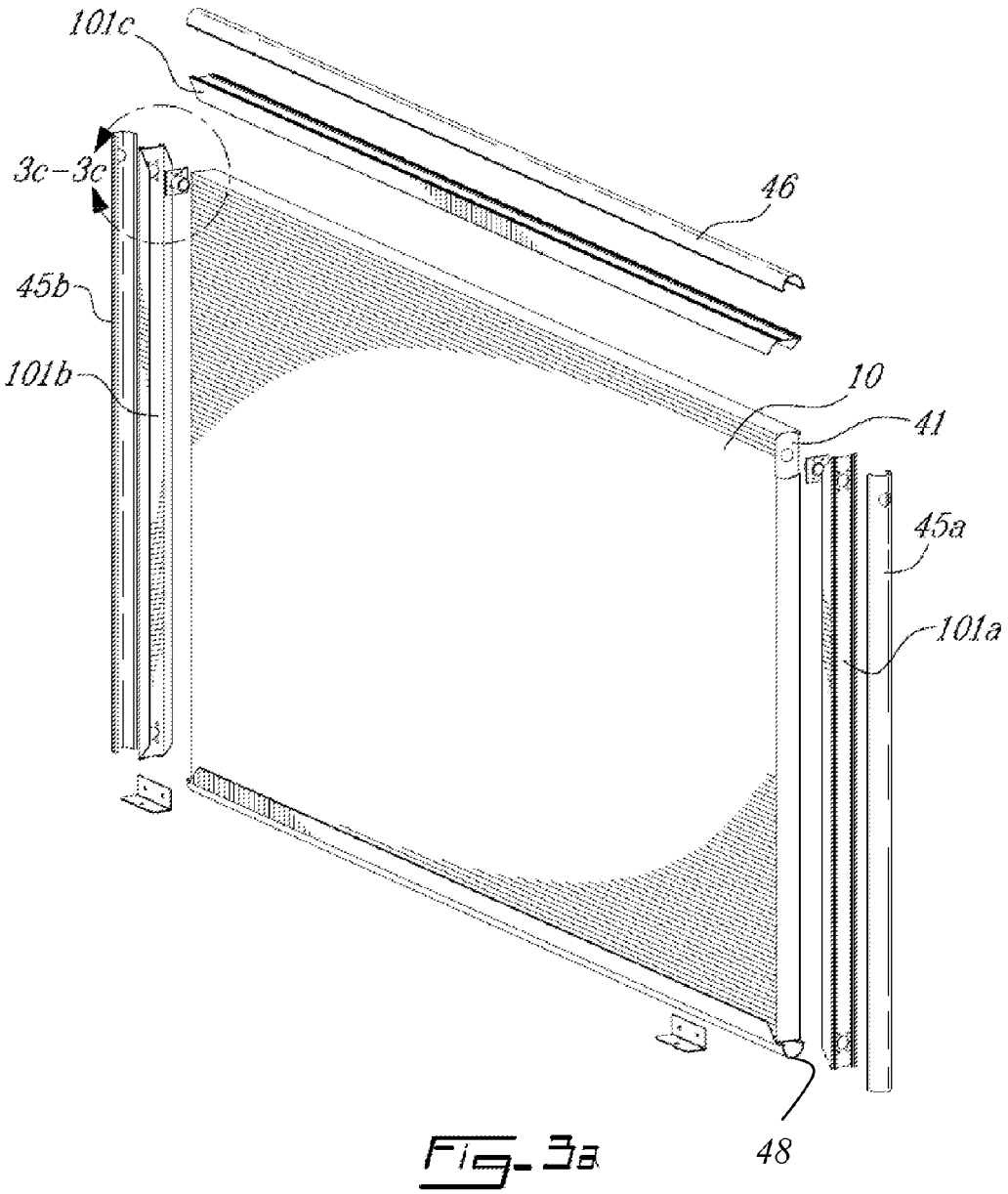
FIG. 3*a* is a perspective exploded view of the breakaway door panel of FIG. 1*a;*
Figure 3B:
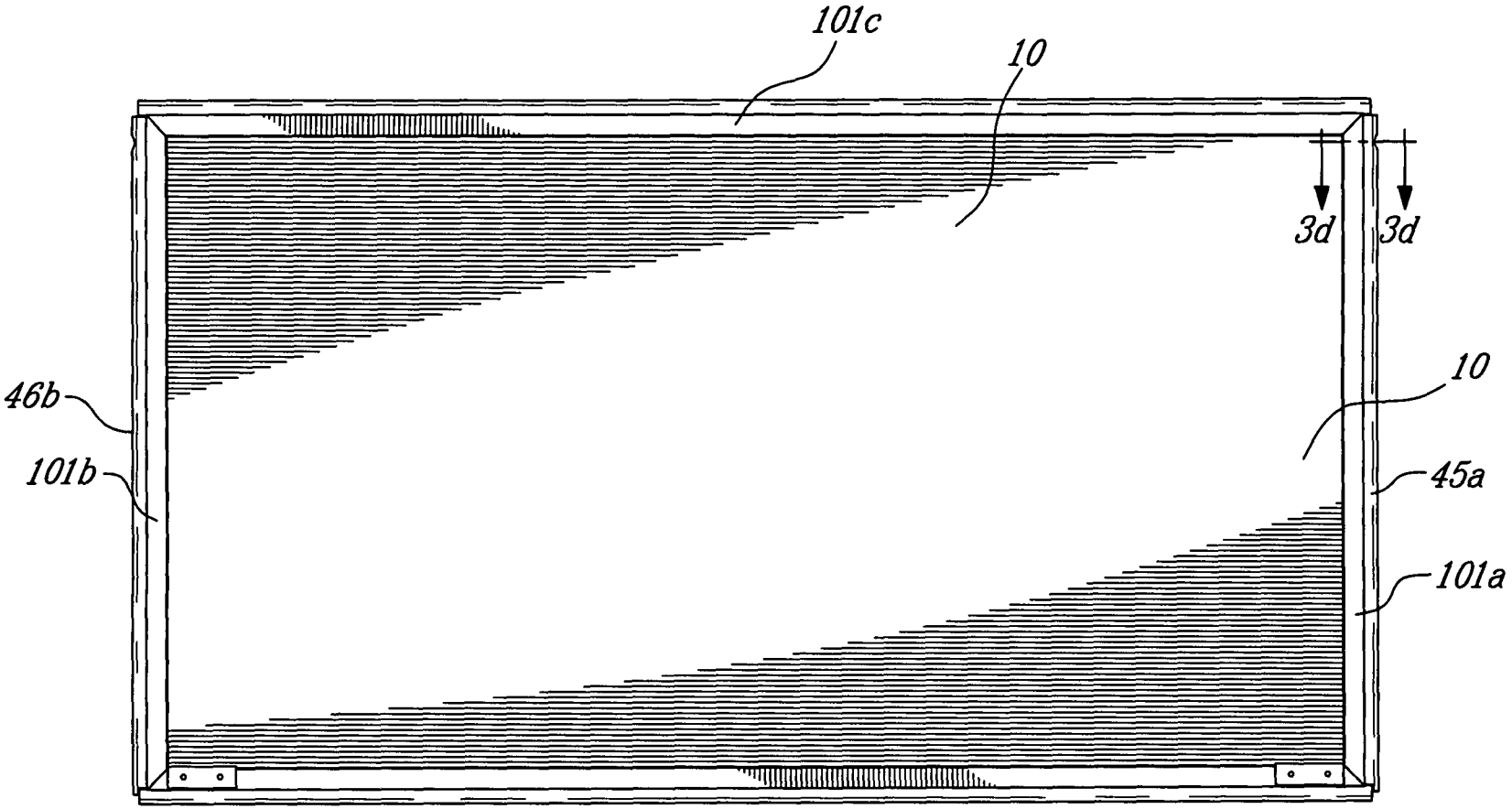
FIG. 3*b* is a front elevation view of the breakaway door panel of FIG. 3*a;*
Figure 3C:
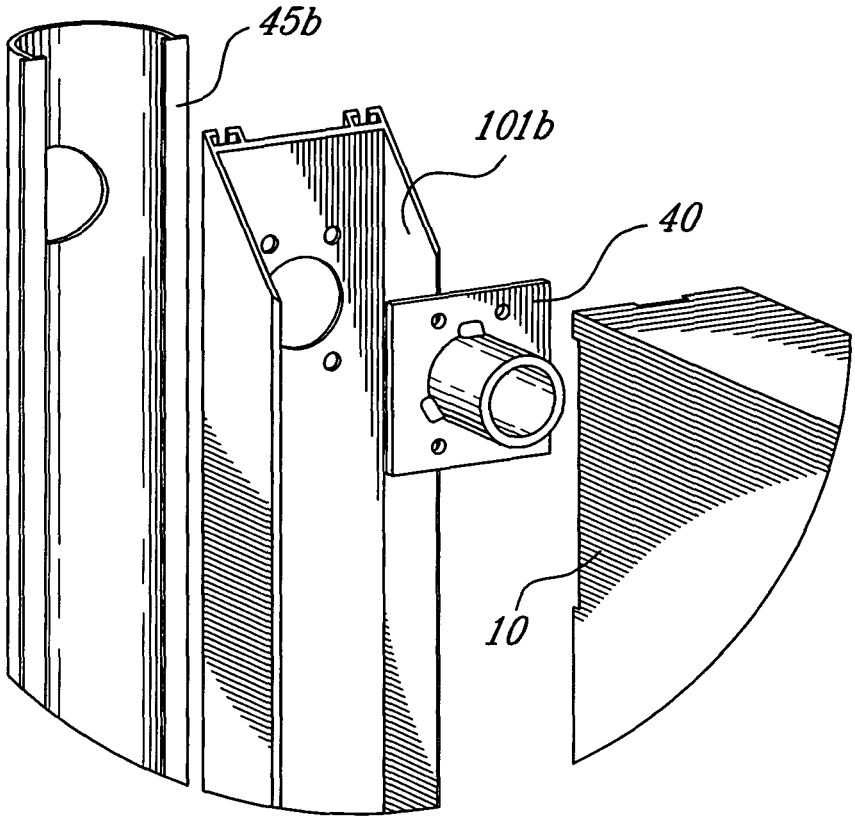
FIG. 3*c* is an enlarged view of detail H of FIG. 3*a;*
Figure 3D:
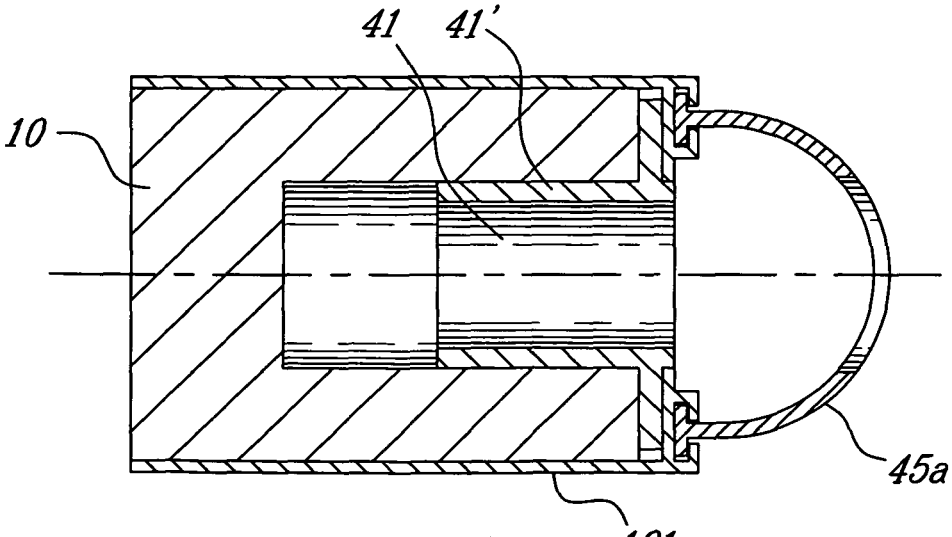
FIG. 3*d* is a top cross-sectional view taken from line I-I of FIG. 3*b;*

To provide fluid and air tight joints between the panel 10 and the surrounding structures, elongated seal members 45*a* and 45*b* are provided at each end of panel 10 (see FIGS. 3*a* and 3*d*). An elongated seal member 48 is also provided at the bottom of the panel 10 (see FIG. 3*a*). Seal members 45*a* and 45*b* are sled into peripheral panel edging members (aluminum extruded profiles) 101*a* and 101*b*. Similarly, as shown in FIG. 1*d*, a similar seal member 46 is mounted on the top edging member 101*c* of the panel 10 to provide a tight articulation between the pivoted edge and the lower edge of fixed panel 12.

One can thus easily appreciate that the above described breakaway door panel system according to illustrative embodiments of the present invention obviates the limitations and drawbacks of the prior art devices. Namely, the invention provides an effective impact resistant knock-out panel configured and sized to swing in either impact direction under a predetermined impact force, thanks to a simple and cost effective impact releasable panel locking device easily user repositionable after trigging. Further, the system may be retrofitted onto any standard door mounting tracks and structure. It is also obvious that the system of the present invention may be adapted to any type of rigid door to preserve the door and its supporting frame from damages potentially caused by impacts on the door.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of illustrative embodiments thereof, it can be modified, without departing from the spirit, scope and nature of the subject invention as defined in the appended claims.

What is claimed is:

1. A breakaway door panel system to be mounted to tracks via rollers;

the system comprising:

first and second connecting members to which first rollers and second rollers are respectively mounted, wherein each of the first and second connecting members is a single unitary member; the first and second connecting members respectively including first and second shafts so mounted thereto as to face each other;

a first door panel extending between and fixedly connected to the first and second connecting members;

an impact resistant door panel including first and second bores positioned on both sides of the impact resistant door panel and at an offset from a top edge of the impact resistant door panel, the first and second bores defining a horizontal pivot axis of the impact resistant door panel, the impact resistant door panel comprising a top section defined between the top edge of the impact resistant door panel and the horizontal pivot axis and a bottom section defined between the horizontal pivot axis and a bottom edge of the impact resistant door panel, the first and second bores being so configured, sized and positioned as to respectively receive the first and second shafts for thereby pivotally mounting the impact resistant door panel to and between the first and second connecting members so as to provide pivotal movement about the horizontal pivot axis of the impact resistant door panel with respect to the first door panel;

a top seal member between mounted on the top edge of the impact resistant door panel and interfacing with a lower edge of the first door panel, side seal members provided at each lateral end of the impact resistant door panel, and a bottom seal member provided at the bottom of the impact resistant door panel, the top, side and bottom seal members providing fluid tightness and air tightness between the impact resistant door panel and surrounding structures; and an impact releasable door panel locking device for releasably locking the impact resistant door panel to at least one of the first and second connecting members;

wherein, when an impact force of at least a predetermined magnitude is applied to either side of the bottom section of the impact resistant door panel, the impact releasable door panel locking device allows the bottom section of the impact resistant door panel to pivot with respect to the first door panel in a direction of application of the impact force while the top section of the impact resistant door panel pivots with respect to the first door panel in direction opposite to the application of the impact force; and wherein the top seal member is in contact with the lower edge of the first door panel when the impact resistant door panel is not pivoted with respect to the first door panel and wherein the to seal member is not in contact with the lower edge of the first door panel when the impact resistant door panel is pivoted with respect to the first door panel.

2. The breakaway door panel system recited in claim 1, wherein the impact releasable door panel locking device comprises:

a first holding element mounted to the impact resistant door panel in the proximity of one of the first or second connecting members;

a second holding element mounted to the one of the first or second connecting members being in the proximity of the first holding element; and a connecting bar so configured and sized as to be releasably connectable to the first and second holding elements.

3. The breakaway door panel system recited in claim 1, wherein the impact resistant door panel comprises a center core laminated on both faces with a reinforcing layer, wherein the center core is at least one of the following: expanded polystyrene and a honeycomb structure.

4. The breakaway door panel system recited in claim 3, wherein the reinforcing layer includes a continuous fiber reinforced thermoplastic reinforcing layer.

5. The breakaway door panel system recited in claim 3, wherein the impact resistant door panel further includes an esthetic film laminated on the reinforcing layer.

6. The breakaway door panel system recited in claim 1, further comprising at least one lock provided between the impact resistant door panel and one of the first and second connecting members.

7. The breakaway door panel system recited in claim 2, wherein the first and second holding elements are made of a resilient material.

8. The breakaway door panel system recited in claim 7, wherein the first and second holding elements each define a mouth and a bore.

9. The breakaway door panel system recited in claim 8, wherein the connecting bar is generally cylindrical and has a diameter similar to a diameter of the bores of the holding elements.

10. The breakaway door panel system recited in claim 9, wherein the connecting bar includes at least one longitudinal flat surface which is so configured and sized as to allow the connecting bar to be inserted in the first and second holding elements by the mouths thereof using a force of lower magnitude than the predetermined magnitude.

11. The breakaway door panel system recited in claim 2, wherein the connecting bar is made of a material including steel.

12. The breakaway door panel system recited in claim 2, wherein the connecting bar includes a handle.

13. The breakaway door panel system recited in claim 1, wherein the impact resistant door panel is so pivotally mounted between the first and second connecting members as to have a pivotable range of about 90 degrees with respect to the first door panel.

* * * * *